US006659587B2

(12) United States Patent
Berg et al.

(10) Patent No.: US 6,659,587 B2
(45) Date of Patent: Dec. 9, 2003

(54) WASTE FLUID COLLECTION CONTAINER

(75) Inventors: Richard H. Berg, Rochester, NY (US); Robert J. Tannascoli, Webster, NY (US); Donald M. Stevens, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 64 days.

(21) Appl. No.: 10/020,993

(22) Filed: Dec. 19, 2001

(65) Prior Publication Data

US 2003/0112289 A1 Jun. 19, 2003

(51) Int. Cl.[7] ..... B41J 2/165; B41J 2/185
(52) U.S. Cl. ..... 347/36; 347/90
(58) Field of Search ..... 347/36, 90, 89, 347/86

(56) References Cited

U.S. PATENT DOCUMENTS

| | | | | |
|---|---|---|---|---|
| 5,432,538 | A | 7/1995 | Carlotta | 347/30 |
| 5,517,221 | A | 5/1996 | Nguyen | 347/31 |
| 5,980,018 | A | 11/1999 | Taylor et al. | 347/31 |
| 5,988,787 | A | 11/1999 | Watanabe et al. | 347/22 |
| 6,126,267 | A | 10/2000 | Ito et al. | 347/35 |
| 6,130,684 | A | 10/2000 | Premnath et al. | 347/30 |
| 6,224,200 | B1 | 5/2001 | Higuma et al. | 347/86 |
| 6,238,035 | B1 | 5/2001 | Barinaga | 347/28 |

*Primary Examiner*—Thinh Nguyen
(74) *Attorney, Agent, or Firm*—Joseph M. Young

(57) ABSTRACT

A waste fluid collection container, which includes a tray having a floor defined by a periphery, where the floor has a plurality of raised flow enhancing areas and a fluid absorbing member that sits inside the tray. In embodiments, the raised areas are elongated ridges extending outwardly from a central area. In other embodiments, the raised areas are a plurality of studs.

19 Claims, 5 Drawing Sheets

WASTE FLUID COLLECTION CONTAINER

BACKGROUND AND SUMMARY

The present invention relates generally to fluid ejection devices and, more particularly, to a waste fluid collection container for collecting waste fluid ejected from such a device.

There are numerous situations where one needs to collect waste fluids. For example, if waste fluids are released inside machinery, such as a copier or printer, it can be necessary to collect these fluids so that they do not damage the surrounding machinery. Also, when changing the oil in an automobile, the oil must be collected and brought to a safe disposal location. To save the time and cost associated with emptying or changing collection containers, it is desirable to maximize the collection potential of a collection container.

Ink jet printers are a specific example of machinery that produces waste fluid, e.g., ink. In addition to ejecting ink onto paper or other substrates, ink jet printers also eject ink at other times. As part of the printhead maintenance routine, many ink jet printers eject ink periodically to keep them unclogged and working. This is referred to in the art as spitting. A printer controller will position the print cartridge at a maintenance station having a spit station or spittoon and cause the printhead to eject ink into the spittoon after a print cartridge has been away from a maintenance station for a specific length of time. The printer controller does this to prevent the ink or meniscus in the little used nozzles from drying and becoming too viscous. A receptacle is used to collect this ink in order to prevent a mess from being created and to prevent damage to other components of the printer.

Some printheads also eject ink during a priming process. For example, some priming processes involve applying a vacuum to the front face of the printhead to pull ink through the nozzles to initially prime the printhead or remove air bubbles or dried ink. A receptacle may also be used to collect ink ejected during such a priming process. When the printhead nozzle face ejects ink, ink that is removed from the nozzles (waste ink) is either ejected directly into a receptacle having a waste pad therein, or it is transported indirectly through ducts or tubing to the receptacle and waste pad via a vacuum pump and tubing.

More specifically, ink is absorbed into the pad. However, sometimes the waste pad will stop absorbing and overflow with ink. This happens because the ink does not flow through the whole pad, but flows a ways into it and stops progressing. This happens most often with inks containing carbon. The ink remains suspended some distance from the floor of the waste receptacle. The water evaporates out of the ink inside the perimeter of the hole thus impeding the ability for fresh ink to spread through the foam.

Previous receptacle designs were simply flat on the bottom. When the tar-like ink residue impedes new ink from spreading throughout the foam, the new ink fills the hole in the waste pad and rises out of the receptacle itself. This is a major concern since ink leaking out of the printer will upset the customer.

Embodiments of the present invention include a waste fluid collection container having a floor defined by a periphery. The floor has a set of raised ridges located extending outward from a central area. The container also includes a wall or walls located along said periphery and attached to and surrounding the floor. The container further includes a fluid absorbing member that sits inside the collection container.

Other embodiments of the invention include a waste fluid collection container having a floor having a plurality of cylindrical studs thereon. The container also includes a wall located along said periphery and attached to and surrounding the floor. The container further includes a fluid absorbing member that sits inside the collection container.

BRIEF DESCRIPTION OF THE DRAWINGS

Embodiments will be described in detail herein with reference to the following figures in which like reference numerals denote like elements and wherein.

DETAILED DESCRIPTION OF EMBODIMENTS

Figure 1:
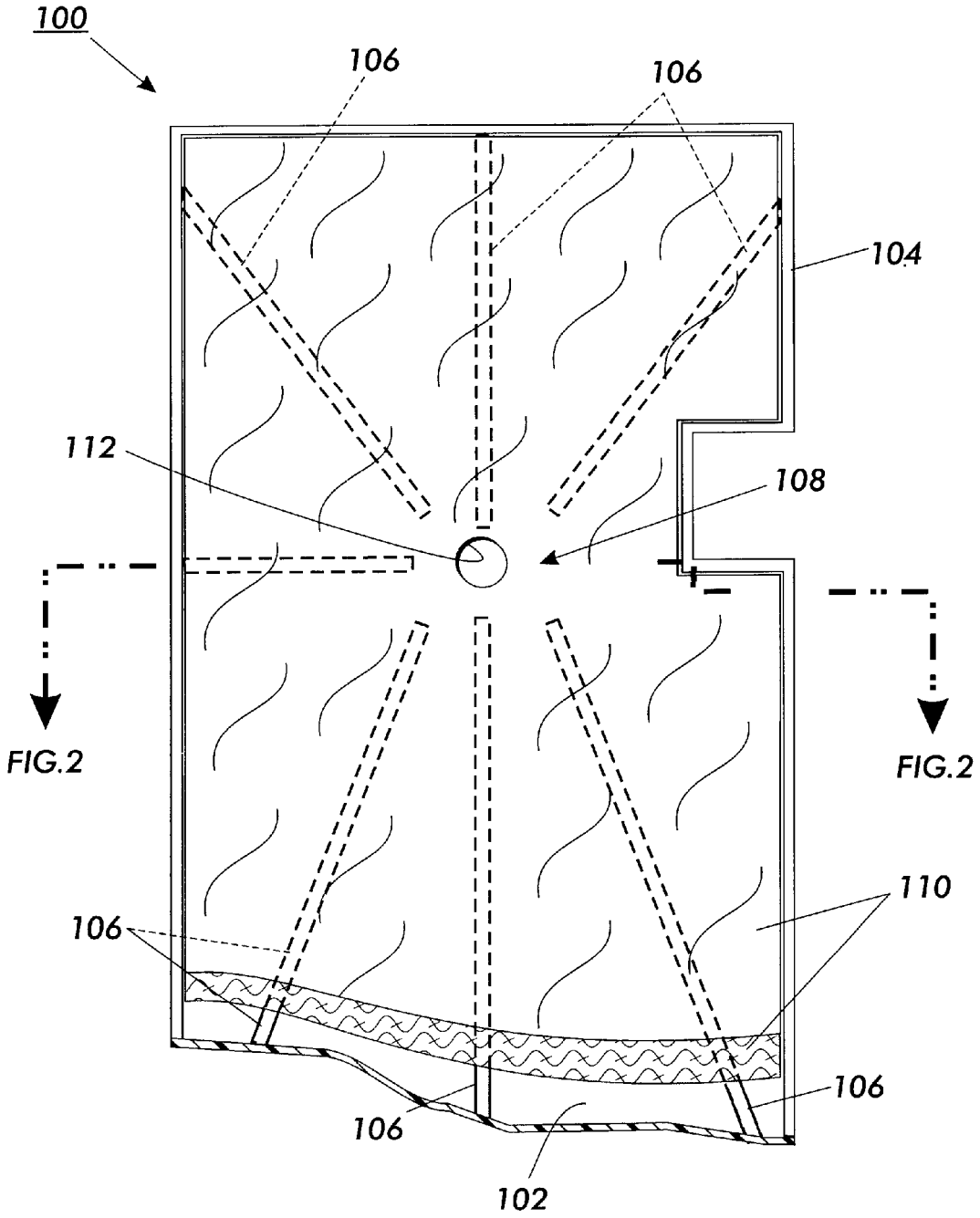
FIG. 1 is a schematic top plane view of an embodiment of a waste fluid collection receptacle.

While the present invention will be described with reference to specific embodiments thereof, it will be understood that the invention is not to be limited to these embodiments. On the contrary, it is intended that the present invention cover all alternatives, modifications, and equivalents as may be included within the spirit and scope of the invention as defined by the appended claims. Other aspects and features of the present invention will become apparent as the description proceeds, wherein like reference numerals have been used throughout to designate identical elements. It is further noted that all references cited in this specification, and their references, are hereby incorporated by reference where appropriate for relevant teachings of additional or alternative details, features, and/or technical background.

The invention is a new design for a waste fluid collection container or receptacle. One specific use of the container is for collecting waste ink in an ink jet printer. For examples of ink jet printers, refer to U.S. Pat. Nos. 5,432,538 and 6,130,684, the disclosures of which are totally incorporated herein by reference. These patents are only meant to give examples of types of ink jet printers and the embodiments of the invention disclosed below are not limited to use with the printer embodiments disclosed therein.

FIG. 1 illustrates an embodiment of the waste ink collection container of the present invention. It includes a tray 100 having a floor 102 and a surrounding wall 104. The general shape of the periphery of the floor is not important and the particular geometry of the border of the floor 102 shown in FIG. 1 should not be considered limiting. This particular shape works well in some printers, but the shape of an ink collection tray will be different depending on the particular size, shape, and configuration of the machine in which it is used. The embodiment shown in FIG. 1 also includes an absorbent pad 110 placed inside the tray.

In embodiments, the wall 104 is connected to the floor along the floor's periphery. The location of the wall 104 does not have to exactly coincide with the periphery of the floor 102. For example, the wall may be located a distance, such as an inch, inward from the edge of the floor. It is there to prevent ink from seeping out of the tray. The wall and floor together define a volume in which to contain ink ejected during either a priming or a spitting operation.

In embodiments, the tray floor has a plurality of elongated raised ridges 106 that extend outward from a central area 108. In embodiments, the ridges 106 are molded into and are integral and one-piece with the bottom of the tray. The ridges 106 form flow channels between the pad 110 and the floor 102. The channels increase the spread of ink through capillary action, thereby exposing a larger surface area of the pad to ink. Exposing more surface area of the pad to the ink increases the amount of ink absorbed by the pad.

In embodiments of the tray for use in ink jet printers, the ridges 106 are approximately 0.6 mm high and 2.0 mm wide. These dimensions can and likely would be different for use in different ink jet printers or other devices producing waste fluid. The dimensions depend upon multiple factors including, but not limited to, the size of the tray, the density of the ridges, the height of the tray, and the weight of the pad. Generally, the ridges should not be too high or the capillary channels formed will be too large to be effective. In embodiments, it was found that a height much larger than 1 mm would not be as effective. If the ridges are too short, they can be difficult to mold and their effectiveness can be compromised as the pad 110 might conform to the gaps and choke off the capillary channels. For the ink jet printers in which these trays were tested, ridges much smaller than 0.5 mm would not be as effective. With respect to the width of the ridges 106, they should be wide enough for easy molding.

Figure 3:
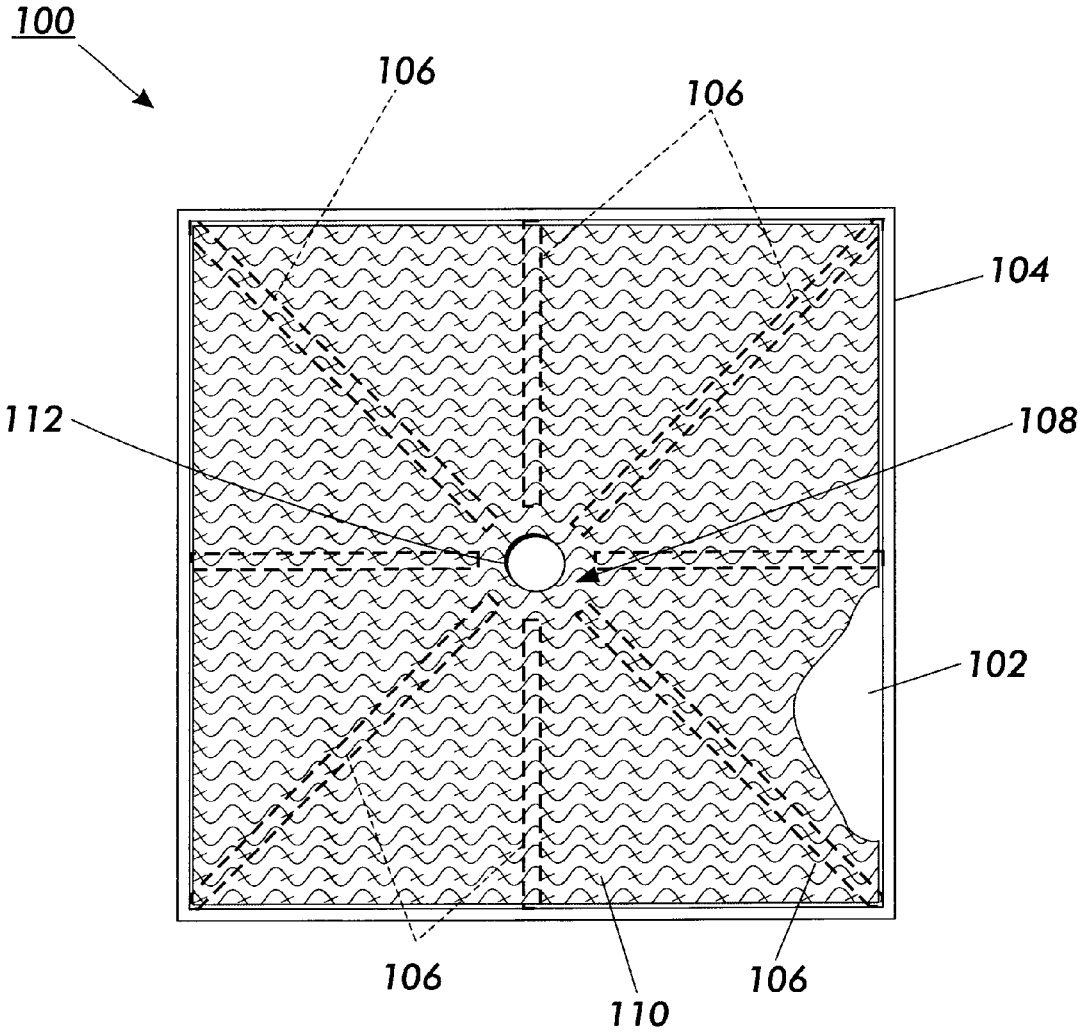
FIG. 3 is a schematic top plane view of an embodiment of a waste fluid collection receptacle having radially symmetric ridges on its floor.

In embodiments, the majority, if not all, of the ridges 106 do not extend radially outward from the central area 108. In other words, if the ridges 106 were extended inward, they would not all pass through a common center point of the central area 108. In some cases, radial ridges may not be as effective as non-radial ridges. However, in embodiments where the tray is symmetrical, such as in FIG. 3, radial ridges might be used.

The central area 108 is useful in creating flow channels down each rib. In embodiments, the area used was approximately 27 mm in diameter, though a range of 25 to 30 mm should be effective. As with the ridges 106, the diameter of the area can and will vary depending on the size of the tray.

Figure 2:
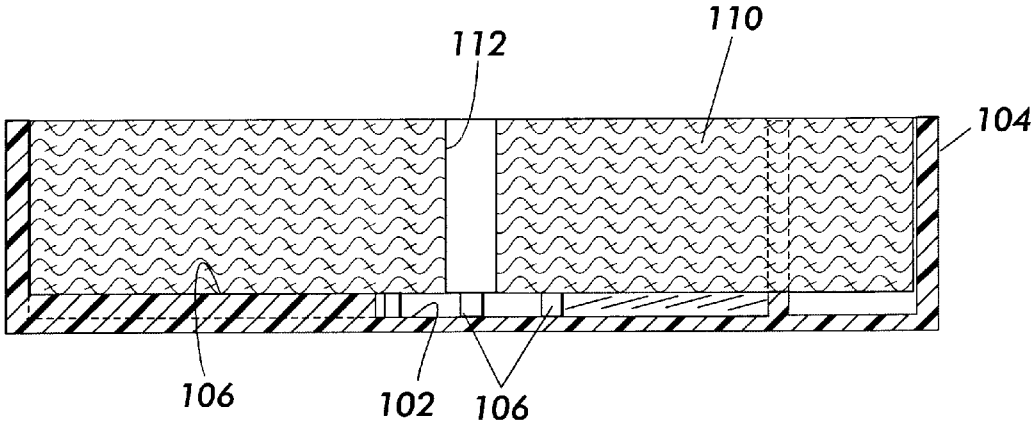
FIG. 2 is a cross section of an embodiment of the waste ink receptacle of FIG. 1.

FIG. 2 illustrates a cross section of the embodiment shown in FIG. 1. The absorbent member or pad 110 has a hole 112 cut through it. The hole is located so that when the pad is placed in the tray, the hole is positioned over the central area 108 from which the raised ridges 106 extend. In embodiments, the absorbent pad 110 is shaped to fit the contours of the ink tray 100. The pad of absorbent material absorbs the ink and is partially exposed to the atmosphere, so that the liquid portion of the ink absorbed therein evaporates maintaining adequate ink storage volume for repeated subsequent cycles of priming and nozzle clearing droplet ejections. Additionally, opening the hole up in the bottom layer increases the surface area for the ink to spread into the wall of the pad, local to the waste tube. In embodiments, the absorbent pad 110 is made of felt.

When the collection container is in use in a machine, ink is deposited into the container from above through hole 112. In embodiments, the hole has a diameter of approximately 13 mm. The interior wall of the hole may absorb some ink as it enters the hole, but the majority will contact the floor in the central area 108. Here it begins to seep along the floor 102 between the absorbing pad 110 and the floor. Depending on the amount of ink being deposited, the area could begin to fill, in which case more ink would be absorbed through the interior wall of hole 112.

The radial ridges 106 enhance the spreading of the ink across the floor 102. The ink spreads via the corners between the ridges 106 and the floor 102. This exposes a greater portion of the surface area of the absorbing pad 110 to the ink. Because the ink contacts more of the surface area of the pad 110, a greater volume of the absorbing pad can be used before the pad needs to be discarded and replaced.

As the absorbent material needs to be at least partially exposed to the atmosphere, most embodiments will not include a lid or other covering, although one can place a lid with a hole cut in it over the top of the receptacle. The hole would be required to admit ink into the collection container. If a covering or lid is used in conjunction with the present invention, it can be perforated so that water may evaporate out of the absorbent pad. The covering may also be designed to only partially cover the pad so as to expose a portion of its surface to the atmosphere.

Figure 4:
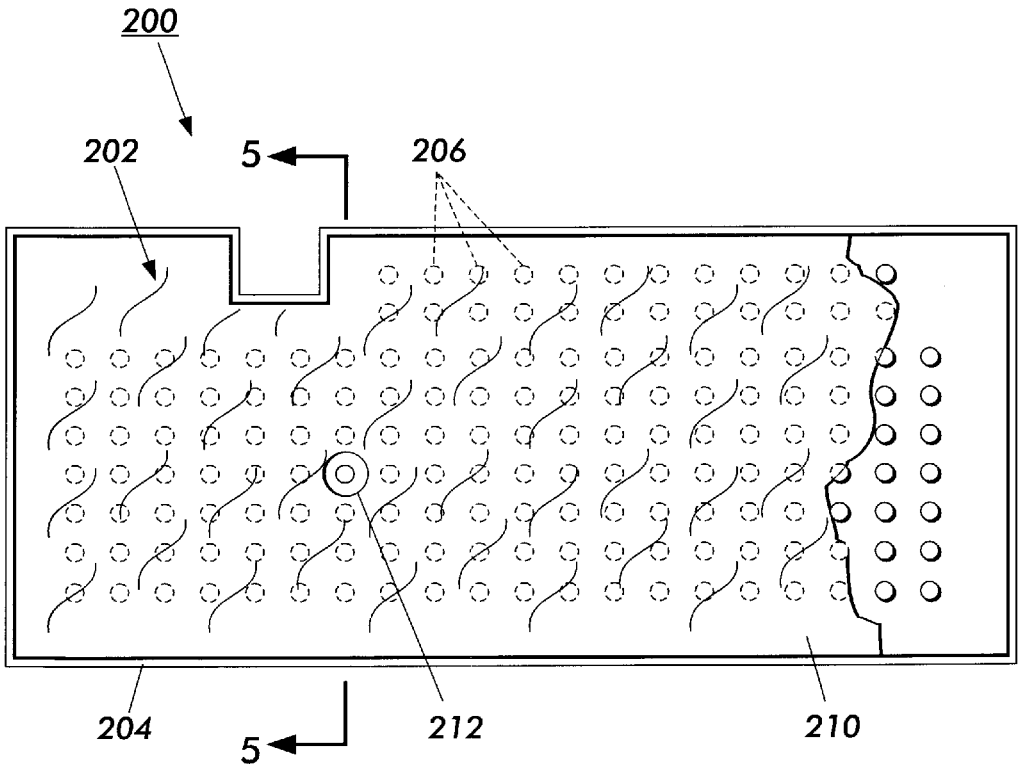
FIG. 4 is a schematic top plane view of an alternative embodiment of a waste fluid collection receptacle of the present invention.
Figure 5:
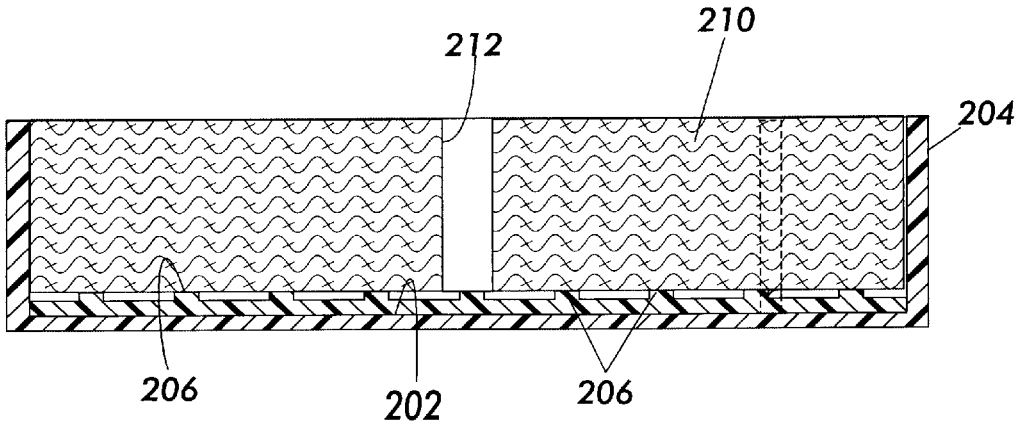
FIG. 5 is a cross section of an embodiment of the waste ink receptacle of FIG. 4.

FIGS. 4 and 5 show another embodiment of a waste ink collection container. It also includes a tray 200 having a floor 202 and a surrounding wall 204, the particular geometry of which is not important. When the tray is in use in a machine, we can use an absorbent pad 210 similar to or the same as the one that is used with the radial ridge tray 100. However, instead of ridges in the floor, the floor includes protrusions 206. In embodiments, these protrusions 206 are pin fins or cylindrical studs. The protrusions or studs 206 allow ink to spread over the floor before being absorbed by the pad 210. In embodiments, the studs are approximately 2–3 mm in diameter and approximately 0.5–1.0 inches high.

In the embodiment depicted in FIGS. 4 and 5, the pins are shown laid out in rows and columns. However, they do not have to be in a linear or uniform pattern. There are a myriad number of ways to arrange the studs on the floor of the tray and the pattern shown in FIGS. 4 and 5 should not be considered limiting. There is also no central flat area similar to the central area 108 in the ridge embodiment. This is primarily because the ridged embodiment uses capillary action and flow channels. For the embodiment of FIGS. 4 and 5, having a central flat area would probably not offer a great advantage to the user. However, there is no reason why a central flat area could not be included in tray 200, and its absence should not be considered limiting.

Ink is still deposited into the container from above through a hole 212 in pad 210. The studs enhance the spreading of the ink across the floor 202, thus enabling the ink to contact a greater portion of the surface area of the absorbing pad 210. This in turn allows use of a greater portion of the absorbing pad.

Although the primary embodiments discussed in this description have been directed toward ink jet printers, it is also expected that this tray design may have uses other than in printers. The improved absorption observed because of the ridges can have uses in the collection of other fluid waste products such as, for example, oil and the exact composition of the absorbent pad may change based on what particular fluid was being collected.

While the present invention has been described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

What is claimed:

1. A container, comprising:

a floor;

a central, substantially flat area;

a plurality of raised ridges extending upwardly from the floor and substantially linearly outward from the central area;

a fluid absorbing member situated on said floor.

2. The container of claim 1, where the plurality of ridges extend substantially radially outward from the central area.

3. The container of claim 1 wherein each of the plurality of ridges has approximately the same height and width.

4. The container of claim 1 wherein each of the plurality of ridges has a respective height and a respective width associated therewith, wherein the respective width is at least double the respective height.

5. The container of claim 1 wherein each of the plurality of ridges has a height greater than or equal to approximately 0.5 mm and less than or equal to approximately 1.0 mm.

6. The container of claim 5 wherein each of the plurality of ridges is approximately 0.6 mm high.

7. The container of claim 5 wherein each of the plurality of ridges is approximately 2.0 mm wide.

8. The container of claim 1 wherein the central area is from approximately 25 mm to approximately 30 mm across.

9. The container of claim 8 wherein the central area has a diameter of approximately 27 mm.

10. The container of claim 1, wherein the ridges are integral and one-piece with the floor.

11. A container, comprising:

a floor;

a plurality of cylindrical protrusions extending upwardly from said floor;

a fluid absorbing member situated on said floor.

12. The container of claim 11 wherein each of the plurality of protrusions has approximately the same height and width.

13. The container of claim 12 wherein the plurality of protrusions is arranged into rows.

14. The container of claim 13, wherein the plurality of protrusions are arranged in columns.

15. The container of claim 12 wherein a height of the protrusions is greater than or equal to approximately 0.5 mm and less than or equal to approximately 1.0 mm.

16. The container of claim 15 wherein a diameter of the protrusions is greater than or equal to approximately 2 mm and less than or equal to approximately 3 mm.

17. The container of claim 11, wherein the protrusions are integral and one-piece with the floor.

18. A waste fluid collection container, comprising:

a plurality of flow enhancing raised areas, each area having the same height and width;

a floor integral with and supporting the plurality of raised areas;

a central substantially flat area of the floor from which the plurality of areas substantially radially project;

a fluid absorbing member located within the container, the absorbing member shaped to fit the area of the floor and having a hole located such that when the pad is in place in the container, the hole is approximately centered over the central area;

a wall located along said periphery and attached to and surrounding the floor.

19. An ink collection container comprising:

a plurality of flow enhancing raised areas;

a floor integral with and supporting the plurality of raised areas;

a fluid absorbing member situated on the floor, the absorbing member having a hole therein.

* * * * *